US007013694B1

(12) United States Patent
Sims

(10) Patent No.: US 7,013,694 B1
(45) Date of Patent: Mar. 21, 2006

(54) PORTABLE, METAL BENDING APPARATUS

(76) Inventor: Steven Don Sims, 3117 Parham Dr., #170, Grand Prairie, TX (US) 75052

( * ) Notice: Subject to any disclaimer, the term of this patent is extended or adjusted under 35 U.S.C. 154(b) by 0 days.

(21) Appl. No.: 10/846,877

(22) Filed: May 14, 2004

(51) Int. Cl.
*B21D 28/00* (2006.01)
*B21D 9/05* (2006.01)

(52) U.S. Cl. ..... 72/331; 72/326; 72/389.7; 72/407; 83/587; 83/639

(58) Field of Classification Search ..... 72/389.7, 72/331, 332, 326, 369, 407; 83/587, 639, 83/697
See application file for complete search history.

(56) References Cited

U.S. PATENT DOCUMENTS 2,098,548 A * 11/1937 Kick ..... 72/389.7
2,451,302 A * 10/1948 Peters ..... 72/389.7
2,502,072 A * 3/1950 Bender ..... 72/389.7
3,442,111 A 5/1969 Ledford et al.
3,451,246 A 6/1969 Miller et al.
3,529,457 A 9/1970 Butler et al.
3,529,458 A 9/1970 Butler et al.
3,563,078 A 2/1971 Mastalski
3,563,443 A 2/1971 Pedrotti et al.
3,564,885 A 2/1971 Fuchs, Jr. et al.
3,643,483 A 2/1972 Minchenko et al.
3,681,958 A 8/1972 Rasmussen
3,735,630 A 5/1973 Sondergaard
3,774,430 A 11/1973 Greer et al.
3,807,214 A 4/1974 Hornung
3,813,914 A 6/1974 Hagemeyer
3,884,062 A 5/1975 Green
3,908,435 A 9/1975 Bowman, Jr. et al.
3,934,450 A 1/1976 Reed
3,975,936 A 8/1976 Baldwin et al.
4,005,596 A 2/1977 Uralsky et al.
4,030,335 A 6/1977 Allenspach
4,111,024 A 9/1978 Dahlman et al.
4,254,651 A 3/1981 Kelly
4,352,280 A 10/1982 Ghosh
4,574,611 A * 3/1986 Hegemann ..... 72/389.7
4,606,214 A 8/1986 Miyazaki
4,790,168 A * 12/1988 Vonthien ..... 72/331
4,912,957 A 4/1990 Petersen et al.
5,005,396 A 4/1991 DeSmet
5,016,457 A 5/1991 Richardson
5,205,146 A 4/1993 Wilkins et al.
5,214,951 A 6/1993 Waddell
5,408,858 A 4/1995 Fukuda
5,415,021 A 5/1995 Folmer
5,426,966 A 6/1995 Krumholz
5,632,172 A 5/1997 Kasmacher
5,819,573 A 10/1998 Seaman
5,901,601 A 5/1999 Fujimoto et al.
6,085,570 A * 7/2000 Preaus ..... 72/389.7

* cited by examiner

*Primary Examiner*—David B. Jones
(74) *Attorney, Agent, or Firm*—Jack D. Stone, Jr.

(57) ABSTRACT

A metal bending apparatus which has a base member and a cross member connected together by two posts extending therebetween. A spring and sleeve are slidably positioned on each post, and a wedge is secured between the sleeves, the wedge includes a pointed end directed toward the base member. A stop is secured on the base member substantially directly under the pointed end of the wedge, and two blocks are positioned on the base member substantially parallel to each other and equidistant from the stop. A jack is positioned between the wedge and the cross member for urging the wedge toward the base member, and for bending a sheet of metal interposed between the wedge and the two blocks.

14 Claims, 2 Drawing Sheets

PORTABLE, METAL BENDING APPARATUS

TECHNICAL FIELD

The invention relates generally to an apparatus configured for bending metal and, more particularly, to an apparatus configured for bending sheet metal.

BACKGROUND

Conventional, when stone setters desire to bend sheet metal for use in securing stone panels to buildings, they manually position the sheet metal over an edge, such as an I-beam, secure it in place, such as with a C-clamp, and bend the metal as desired, typically to an angle of 90°. However, this method of bending metal tends to be laborious and inadequate to bend metal within the tolerances needed for securing stone panels to buildings. As a result, many such connectors are disposed of and costs escalate.

Accordingly, a there is a need for a portable apparatus effective for consistently bending sheet metal within acceptable tolerances.

SUMMARY

The present invention, accordingly, provides a metal bending apparatus which has a base member and a cross member connected together by two posts extending therebetween. A spring and sleeve are slidably positioned on each post, and a wedge is secured between the sleeves, the wedge including a pointed end directed toward the base member. A stop is secured on the base member substantially directly under the pointed end of the wedge, and two blocks are positioned on the base member substantially parallel to each other and equidistant from the stop. A jack is positioned between the wedge and the cross member for urging the wedge toward the base member, and for bending a sheet of metal interposed between the wedge and the two blocks.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
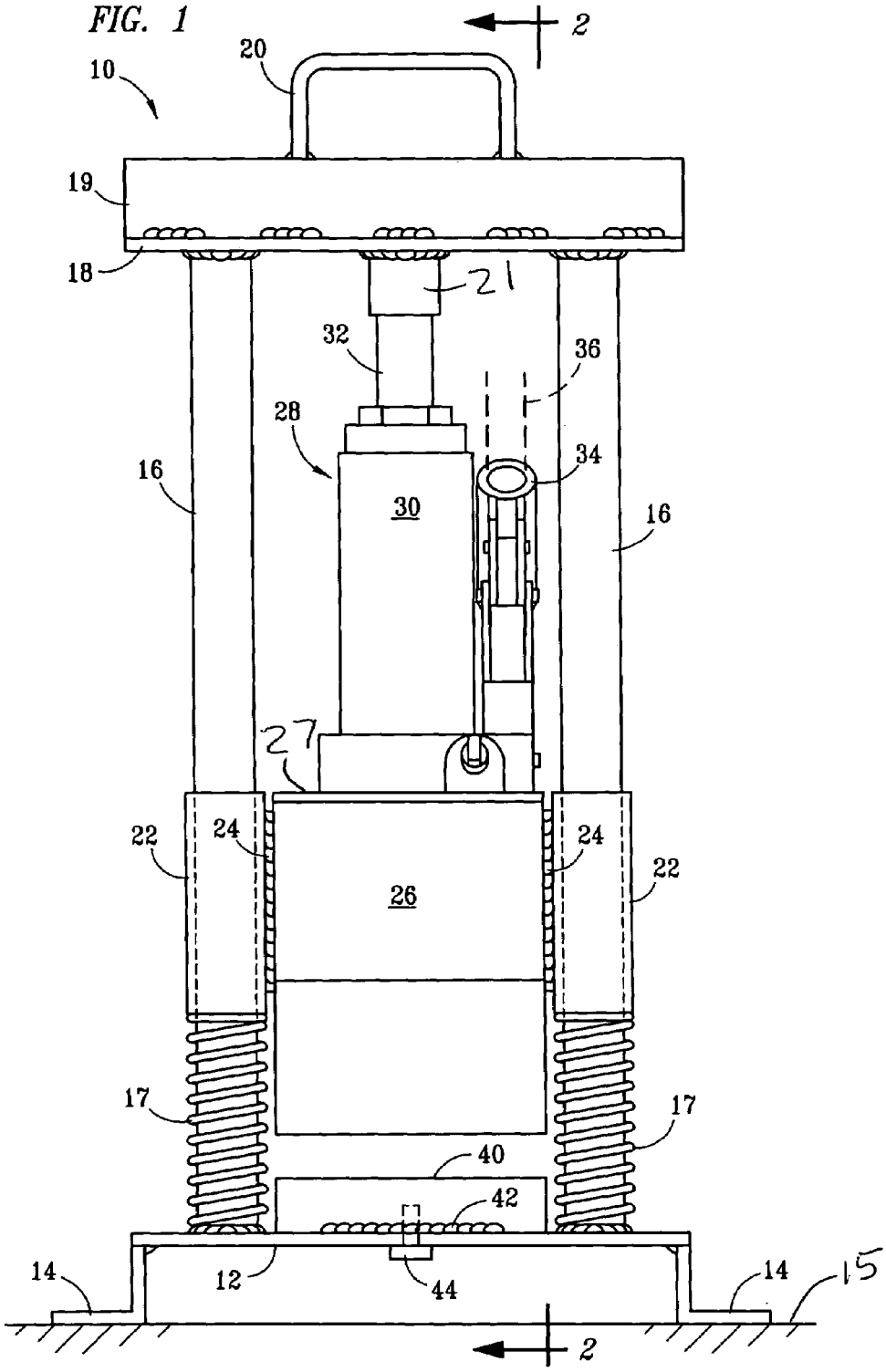
FIG. 1 is a front elevation view of an apparatus embodying features of the present invention.

In the discussion of the FIGURES the same reference numerals will be used throughout to refer to the same or similar components. In the interest of conciseness, various other components known to the art, such as hydraulic jacks, and the like, preferred or necessary for the operation of the invention, have not been discussed in detail. It is noted that references herein to "metal" refer to metallic material, such as, by way of example, conventional carbon steel, but may include any of a number of different materials effective for implementing the invention described herein.

Figure 2:
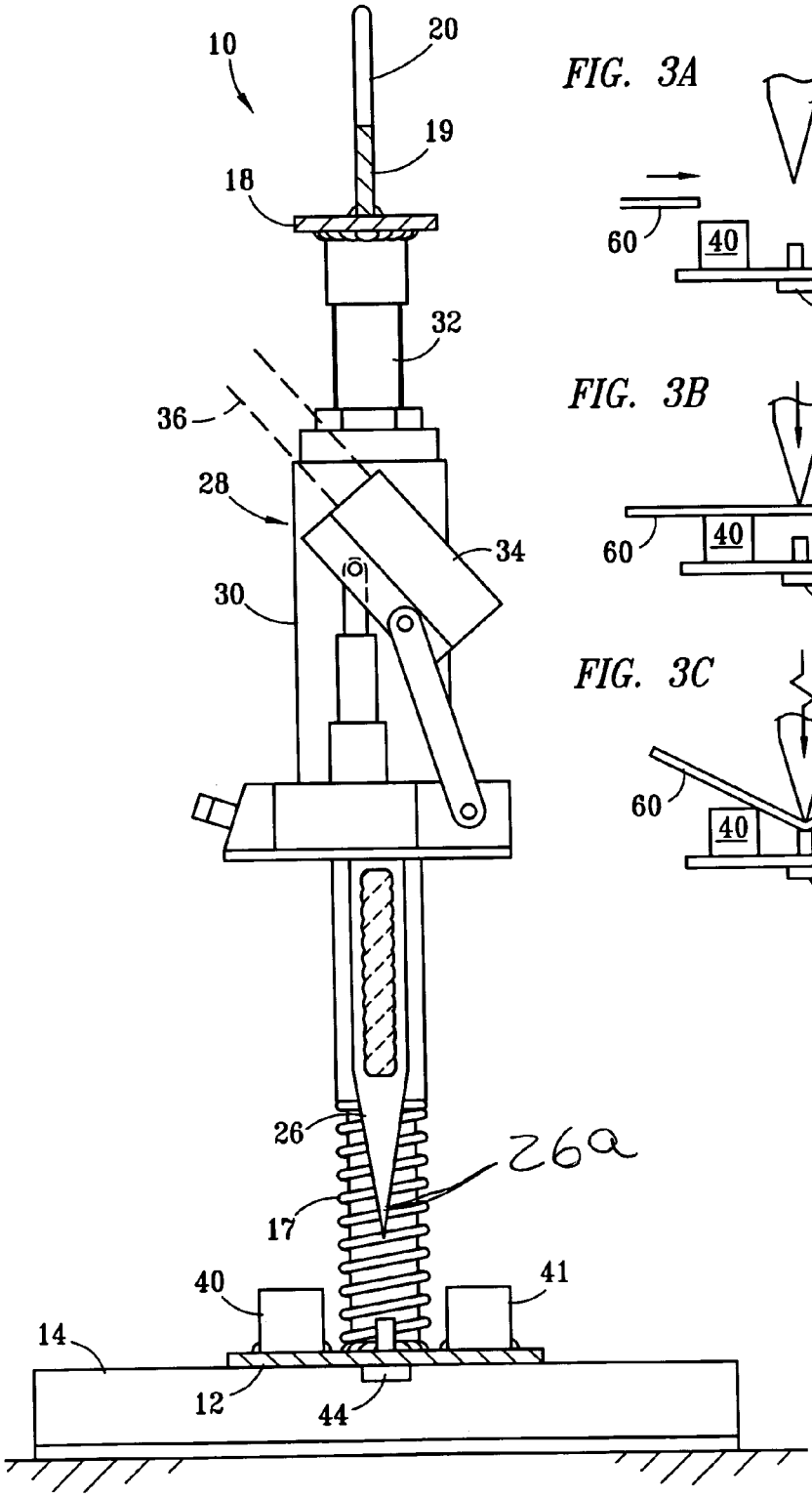
FIG. 2 depicts a side elevation view of the apparatus of FIG. 1.

Referring to FIG. 1 of the drawings, the reference numeral 10 generally designates an apparatus embodying features of the present invention for bending metal. The apparatus 10 preferably includes a base member 12 comprising a metal plate supported by two angle irons 14 positioned on a flat surface 15, such as ground or a floor. As viewed in FIG. 1, two posts 16 are secured (e.g., by welding) at their lower ends to the base member 12, and at their upper ends to a horizontal cross member 18 that spans across the upper ends of the posts 16. As viewed in FIGS. 1 and 2, a vertical cross member 19 is secured (e.g., by welding) across the horizontal cross member 18, and a handle 20 is secured (e.g., by welding) to the top of the vertical cross member 19 to facilitate portably carrying the apparatus 10. It is noted that the cross members 18 and 19 form a T-bar, and alternatively a T-bar may be substituted therefor. A cylindrical receiver 21 is centrally secured (e.g., by welding) on a bottom side of the horizontal cross member 18, for purposes discussed below.

Sleeves 22 are slidably positioned on the posts 16, and springs 17 are positioned on the posts 16 between the sleeves 22 and the base member 12. A wedge 26 is secured (e.g., by welding) between the sleeves 22, such that, as most clearly viewed in FIG. 2, a pointed or angled end 26*a* is directed downwardly toward the base member 12. A wedge plate 27 is preferably positioned (e.g., by welding) on top of the wedge 26. A jack 28, such as a hydraulic jack (shown in FIG. 1) or the like, is positioned on the wedge plate 27. Jacks are considered to be well-known in the industry and, therefore, will not be discussed in further detail herein, except insofar as necessary to describe the present invention. The jack 28 includes a jack body 30 positioned on the wedge plate 27, and a piston extension portion 32 extending into the receiver portion 21. The jack 28 also includes a conventional operational mechanism 34 for receiving a lever 36 (shown in dashed outline) configured for applying activating force to the jack 28.

Two blocks 40 and 41 are positioned and secured (e.g., by welding) on the base member 12, and a stop 44, such as a bolt, or the like, is secured to the base member 12. The stop 44 is preferably centrally positioned between the two blocks 40 and 41, substantially directly beneath the pointed end 26*a* of the wedge 26. The blocks 40 and 41 are sized, configured, and positioned on the base member 12 to facilitate bending sheet metal at a predetermined angle, as discussed in further detail below.

Figure 3A:
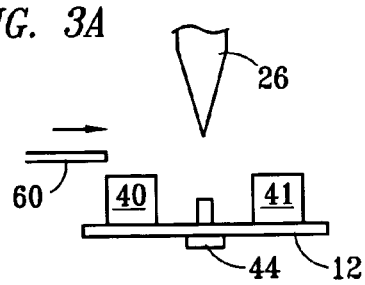
FIGS. 3A–3C schematically depict a method for bending sheet metal by utilizing the apparatus of FIG. 1.
Figure 3B:
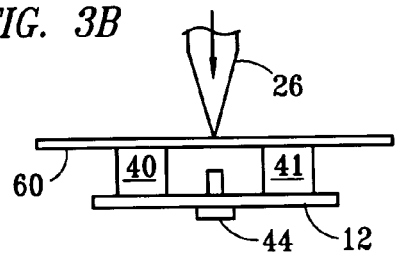
Figure 3C:
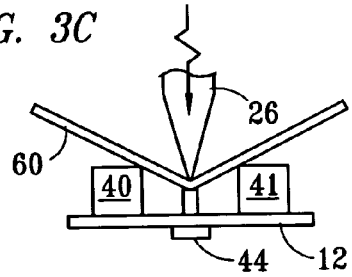

In the operation of the metal bending apparatus 10, as most clearly depicted in FIGS. 3A, 3B, and 3C, a sheet of metal 60 is inserted into the apparatus between the blocks 40 and 41 and the wedge 26, the wedge being maintained in an elevated position by the springs 22 which urge the sleeves 22, and hence the wedge 26, upwardly. The lever 36 is then inserted in the operational mechanism 34 and a user applies force through the lever 36 to the jack 28 in a conventional manner to cause the piston extension portion 32 to extend outwardly from the jack body 30, causing the wedge 26 to move downwardly and compress the springs 17, as shown in FIG. 3B. As the wedge 26 moves downwardly, the pointed end 26*a* of the wedge 26 engages the sheet metal 60. As the wedge 26 continues to move downwardly, the sheet metal 60 deforms, bending at the point of contact with the pointed end 26*a* of the wedge 26, as shown in FIG. 3C. The wedge 26 may continue to be moved downwardly in such manner until further deformation of the sheet metal 60 is resisted by the stop 44, at which point the operation of bending the sheet metal 60 is complete, and the sheet metal may be removed therefrom.

It may be appreciated that the angle of the bend (typically about 90°) in the sheet metal 60, deformed as described above, may be controlled by the size, configuration, and position of the blocks 40 and 41, stop 44, and the angle of the pointed end 26*a* of the wedge 26, all of which are design decisions, the determination of which are considered to be apparent to a skilled artisan upon a review of the present description of the invention and, therefore, will not be discussed in further detail herein.

By use of the present invention, sheet metal may be consistently bent at a precise predetermined angle. The precise position of the sheet metal 60 in the apparatus 10 may also be controlled, for example, by measuring and controlling the distance of an edge of the sheet metal 60 from a block 40 or 41. Additionally, the apparatus may be readily transported to a work site where needed.

It is understood that the present invention may take many forms and embodiments. Accordingly, several variations may be made in the foregoing without departing from the spirit or the scope of the invention. For example, the stop 44 may comprise a bolt that is threaded into the base member 12 and may be adjusted by being screwed in or out, and thereby control the amount of downward movement of the wedge 26 and, hence, of the angle of bend in the sheet metal 60. The stop may be replaced with blocks that rest on the base member 12 and may be readily replaced with blocks of differing sizes (preferably smaller than the blocks 40 and 41), including combinations of blocks and bolts, to thereby control the angle of bend induced in the sheet metal 60. Depending on the stop utilized, the angle irons 14 may not be needed. Depending on the size of the blocks 40 and 41 and the angle of bend desired in the sheet metal 60, the wedge 26 may move downwardly until it is stopped by the base member 12, and the stop 44 may therefore not be needed. The jack 28 may be hydraulic, pneumatic, electric, mechanical, a screw mechanism, or the like, effective for urging the wedge toward the base member 12. Depending on the type of jack utilized, the springs 17 may not be needed. While various components of the metal bending apparatus 10 are welded together, they may be secured together via screws, or like fasteners.

The invention may also be used in a number of applications other than bending sheet metal. For example, the apparatus 10 may be utilized in the cutting or breaking of tile.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. An apparatus for bending metal, the apparatus comprising:

a base member;

a cross member;

a first post and a second post, each of which posts include a first end and a second end, said first ends being secured to said base member and a said second ends being secured to said cross member;

a first sleeve and a second sleeve, said first sleeve being slidably positioned on said first post, and said second sleeve being slidably positioned on said second post;

a wedge secured between said first and second sleeves, said wedge having a pointed end directed toward said base member;

a first spring and a second spring, said first spring being positioned on said first post between said base member and said first sleeve, and said second spring being positioned on said second post between said base member and said second sleeve, for urging said wedge away from said base member;

a stop secured on said base member substantially directly under said pointed end of said wedge;

a first block and a second block positioned on said base member substantially parallel to each other and equidistant from said stop; and a jack positioned between said wedge and said cross member.

2. The apparatus of claim 1 wherein said stop is a bolt.

3. The apparatus of claim 1 wherein said stop is a third block smaller than said first or second blocks.

4. The apparatus of claim 1 wherein said jack is a hydraulic jack.

5. The apparatus of claim 1 wherein said jack is a pneumatic jack.

6. The apparatus of claim 1 wherein said jack is an electric jack.

7. The apparatus of claim 1 wherein said jack is a mechanical screw jack.

8. An apparatus for bending metal, the apparatus comprising:

a base member;

a cross member;

a first post and a second post, each of which posts include a first end and a second end, said first ends being secured to said base member and a said second ends being secured to said cross member;

a first sleeve and a second sleeve, said first sleeve being slidably positioned on said first post, and said second sleeve being slidably positioned on said second post;

a wedge secured between said first and second sleeves, said wedge having a pointed end directed toward said base member;

a bolt secured on said base member substantially directly under said pointed end of said wedge;

a first block and a second block positioned on said base member substantially parallel to each other and equidistant from said bolt; and a jack positioned between said wedge and said cross member.

9. The apparatus of claim 8 further comprising a first spring and a second spring, said first spring being positioned on said first post between said base member and said first sleeve, and said second spring being positioned on said second post between said base member and said second sleeve, for urging said wedge away from said base member.

10. The apparatus of claim 8 wherein said stop is a third block smaller than said first or second blocks.

11. The apparatus of claim 8 wherein said jack is a hydraulic jack.

12. The apparatus of claim 8 wherein said jack is a pneumatic jack.

13. The apparatus of claim 8 wherein said jack is an electric jack.

14. The apparatus of claim 8 wherein said jack is a mechanical screw jack.

* * * * *